US012345012B2

(12) United States Patent
Landbø et al.

(10) Patent No.: US 12,345,012 B2
(45) Date of Patent: Jul. 1, 2025

(54) WEAK SOIL ANCHOR DEVICE TO ANCHOR ONE OR SEVERAL STRUCTURES AND METHOD TO ARRANGE AN ANCHOR IN WEAK SOIL

(71) Applicant: DR. TECHN. OLAV OLSEN AS, Lysaker (NO)

(72) Inventors: Trond Landbø, Bekkestua (NO); Jon Hermstad, Oslo (NO)

(73) Assignee: DR. TECHN. OLAV OLSEN AS, Lysaker (NO)

( * ) Notice: Subject to any disclaimer, the term of this patent is extended or adjusted under 35 U.S.C. 154(b) by 67 days.

(21) Appl. No.: 17/640,088

(22) PCT Filed: Aug. 28, 2020

(86) PCT No.: PCT/NO2020/050220
§ 371 (c)(1),
(2) Date: Mar. 3, 2022

(87) PCT Pub. No.: WO2021/045626
PCT Pub. Date: Mar. 11, 2021

(65) Prior Publication Data

US 2022/0298739 A1 Sep. 22, 2022

(30) Foreign Application Priority Data

Sep. 5, 2019 (NO) ..... 20191069

(51) Int. Cl.
*E02D 5/80* (2006.01)
*E02D 27/50* (2006.01)
(Continued)

(52) U.S. Cl.
CPC ..... *E02D 5/80* (2013.01); *E02D 27/50* (2013.01); *E02D 27/525* (2013.01); *E02D 9/02* (2013.01); *E02D 2200/1678* (2013.01)

(58) Field of Classification Search
CPC ..... E02D 5/80; E02D 27/50; E02D 27/525; E02D 2200/1678; E02D 5/54
See application file for complete search history.

(56) References Cited

U.S. PATENT DOCUMENTS 1,133,496 A * 3/1915 Noakes ..... E02D 5/80 52/155
3,583,497 A * 6/1971 Kussowski ..... E02D 7/18 74/61
(Continued)

FOREIGN PATENT DOCUMENTS

DE 3507269 * 5/1986
EP 0110853 * 6/1984
(Continued)

OTHER PUBLICATIONS https://www.thefreedictionary.com/bracket.*
(Continued)

*Primary Examiner* — Sean D Andrish
(74) *Attorney, Agent, or Firm* — F. Brent Nix, Esq.; Johnson, Marcou, Isaacs & Nix, LLC; Jennifer Stachniak, Esq.

(57) ABSTRACT

Weak soil anchor device (1) for anchoring a number of structures, as well as method for arranging an anchoring in weak soils. Seen in a vertical operating position, the weak soil anchor device (1) comprises: an elongate inner continuous open box structure (2) with a triangular cross-section comprising a first wall surface (3), second wall surface (4) and third wall surface (5), an outer continuous open box structure (10) with a smaller vertical extent than the inner box structure (2) and having a triangular cross-section consisting of a first outer wall surface (11), second outer wall surface (12) and third outer wall surface (13), the vertical center area (14) of the first, second and third outer wall surfaces is connected to the inner elongate continuous open box structure (2) in a lower area of respectively an outer edge area between the first and second wall surface (3, 4), second and third wall surface (4, 5) and the third and first wall surfaces (5, 3), and anchor brackets (20) are arranged in a lower outer area of the weak soil anchor device (1), where the weak soil anchor device comprising the inner and outer box structure (2, 10) is lowered down into the weak soils to a desired depth.

14 Claims, 3 Drawing Sheets

(51) Int. Cl.
*E02D 27/52* (2006.01)
*E02D 9/02* (2006.01)

(56) References Cited

U.S. PATENT DOCUMENTS

| | | | | |
|---|---|---|---|---|
| 3,850,128 | A | 11/1974 | Lovell | |
| 6,223,671 | B1 | 5/2001 | Head | |
| 2018/0155892 | A1 * | 6/2018 | Kelleher | H02S 20/10 |

FOREIGN PATENT DOCUMENTS

| | | | |
|---|---|---|---|
| EP | 0157033 | * | 9/1988 |
| EP | 0 312 198 | A1 | 4/1989 |
| JP | 1994-287950 | | 10/1994 |
| JP | 2011-021453 | | 2/2011 |
| KR | 20110077143 | * | 9/2011 |
| WO | WO 95/14147 | * | 5/1995 |
| WO | 2004079100 | A2 | 9/2004 |

OTHER PUBLICATIONS

Dr. Techn. Olav Olsen AS,"International Search Report for PCT/NO2020/050220", Nov. 11, 2020, 2 pages.
Dr. Techn. Olav Olsen AS, "Norwegian Search Report for priority application No. 20191069", Dec. 17, 2019, 2 pages.
Dr. Techn. Olav Olsen AS,"Office Action for Japanese Patent Appln, No. 2022-515077", Jul. 9, 2024, 4pages,, with partial English translation.

* cited by examiner

WEAK SOIL ANCHOR DEVICE TO ANCHOR ONE OR SEVERAL STRUCTURES AND METHOD TO ARRANGE AN ANCHOR IN WEAK SOIL

BACKGROUND OF THE INVENTION

1. Field of the Invention

The present invention relates to a weak soil anchor device for anchoring one or more structures. The invention further relates to a method for arranging an anchoring in weak soils for anchoring one or more structures using the weak soil anchor device. The anchor device is preferably formed to be pushed into the seabed with conventional piling frame equipment or possibly by means of a vibrohammer.

2. Description of the Prior Art

Various anchor types are known today within the scope of the present invention and examples of some of these are discussed below.

Conventional plate anchors or ship anchors, for example of "Vryhof" type. These are formed so that vessels with high towing power pull the anchors so that they dig down into the seabed. These anchor types are widely used, but also have some disadvantages. In some cases, the weak soils are of such a nature that the anchors cannot be pulled down to a sufficiently large depth to achieve the necessary holding force.

Anchor piles normally designed as steel pipe piles. These are installed using pile hammers. These anchors normally have a small diameter and may give too low holding resistance. Furthermore, they have a constant cross-section which entails a relatively large material consumption in the upper soil layer with little holding resistance.

Suction anker. These are installed by mechanical pumps attached to the pile and sucked into the ground. These anchors have a constant cross-section which results in relatively large material consumption in the upper soil layer with little holding resistance. Furthermore, they require a lid on top to establish suction. They also require a special mechanical system to enable installation into the weak soils by means of suction.

SEPLA anchors. These are formed as a plate anchor and pressed into the uncompacted masses by means of a suction anchor. This normally results in a complicated operation.

EP 0312198A1 discloses a pile which has high resistance to pulling when used as an anchor for horizontal or near-horizontal guidance. The pile has an elongated hollow body with a cross-sectional profile in the form of a closed Figure which is asymmetrical about at least one axis, and is preferably triangular, especially an equilateral triangle whose equal angles are in the range 20-45 degrees. The pile body is preferably constructed of plate material, where at least the lower end is open, for easy driving into the carrier material (for example the seabed). A beam-like reinforcing member preferably extends over the interior of the pile body, for the full vertical length of the pile body, to strengthen the pile against bending when it its used for anchoring. A connecting element, such as a hook, is located on the pile, preferably on an edge of the reinforcing beam. In the preferred shapes of the pile, the vertical reinforcing beam forms the apex of an equilateral triangle between its equal side and at 35 degrees equal angles, and the connecting element is at the apex at about the middle length of the pile. Powerful marine anchoring systems are also disclosed which use the piles.

U.S. Pat. No. 3,850,128A discloses an anchor assembly for immersion in a formation below a body of water, comprising an anchor section with an elongate hollow shaft and radially extending tapered plates attached to the lower end thereof, a vibration drive unit and a releasable coupling for connecting said drive unit to said shaft. The vibrational forces fluidize the seabed whereby the anchor tends to sink by its own weight. After immersion, the coupling is deactivated to allow recovery of the drive.

BRIEF SUMMARY OF THE INVENTION

An object of the present invention is therefore to provide a weak soil anchor device which solves the disadvantages and problems of the known anchor types as discussed above.

Another object is that the anchor device should be manufacturable and transportable in a cost-effective manner.

A further object is that the anchor device should be installable in an exact, predetermined position by means of standard frame equipment for piles.

A further object is that the weak soil anchor device should achieve high anchor capacity in deeper weak soils.

A yet further object is that the anchor device should be adapted and dimensioned so that the anchor has a maximum holding capacity in at least three directions, whereby the anchor can be used as a common anchor for a number of constructions.

The objects of the present invention are achieved by a weak soil anchor device for anchoring one or more constructions, characterized in that it, seen in a vertical operating position, comprises:

- an elongate inner continuous open box construction with a triangular cross-section comprising a first wall surface, second wall surface and third wall surface, an outer continuous open box structure with a smaller vertical extent than the inner box structure and with a triangular cross-section consisting of a first outer wall surface, second outer wall surface and third outer wall surface, where the vertical center area of the first, second and third outer wall surfaces is connected to the inner elongate continuous open box structure in a lower area of, respectively, an outer edge area between the first and second wall surfaces, second and third wall surfaces and the third and first wall surfaces, and anchor piles are arranged in a lower outer area of the weak soil anchor device, whereby the weak soil anchor device comprises the inner and outer box structure is lowered into the weak soils to a desired depth.

The object of the present invention is further achieved by a method for arranging an anchoring in weak soils for anchoring one or more structures, where a weak soil anchor device is used, characterized in that it comprises:

- the weak soil anchor device is fitted with anchor lines,
- the weak soil anchor device with fitted anchor lines is lowered with its lower end area against the weak soils, and
- the weak soil anchor device is pressed into the weak soils with conventional frame equipment for piling or by using a vibrohammer.

BRIEF DESCRIPTION OF THE DRAWINGS

In the following, three embodiments of the weak soil anchor device for anchoring one or more (a number) structures according to the invention will be explained with reference to the accompanying Figures, in which.

DETAILED DESCRIPTION OF THE INVENTION

Figure 1:
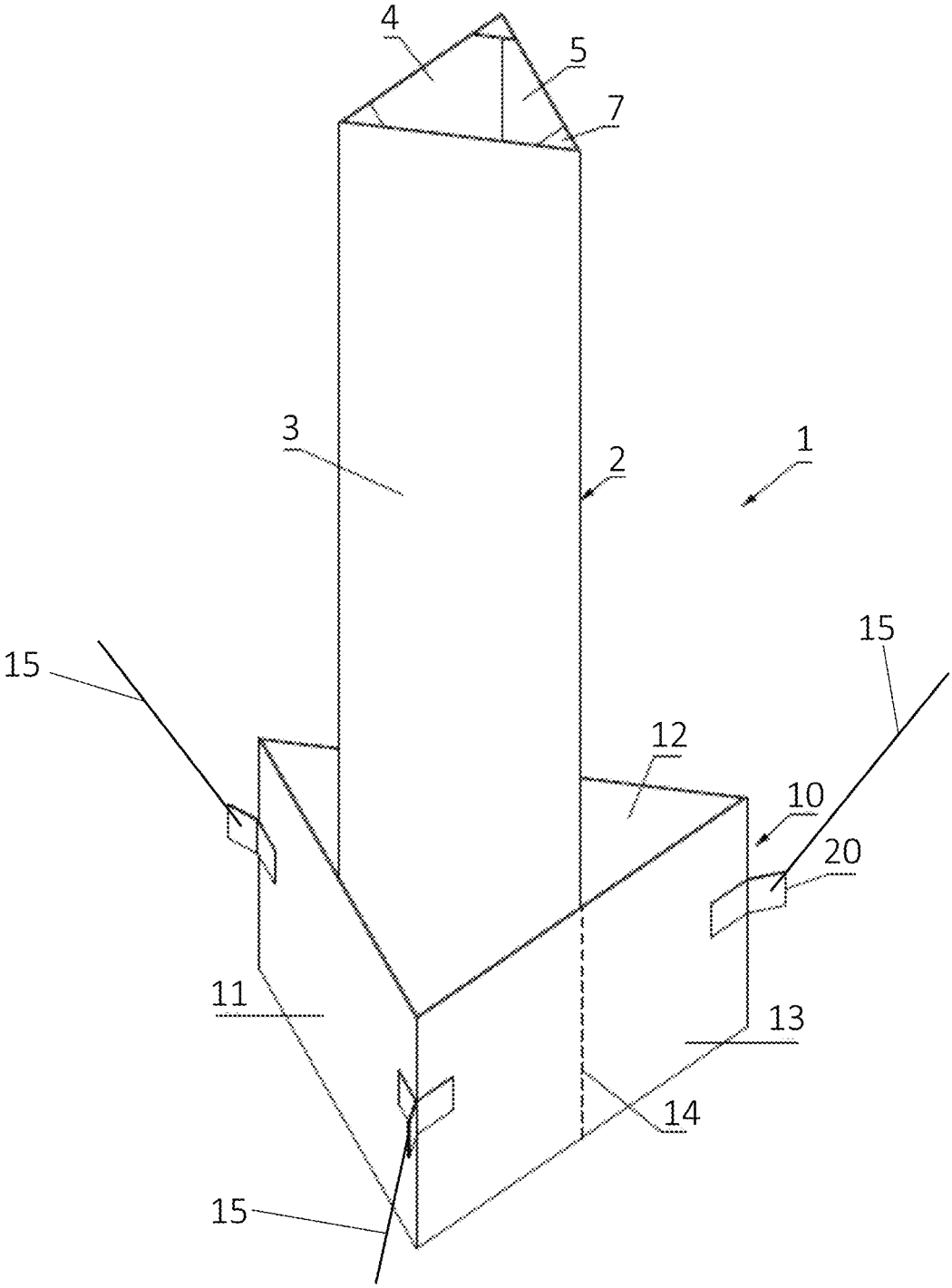
FIG. 1 shows an embodiment of the weak soil anchor device for anchoring a number of structures according to the invention.
Figure 2:
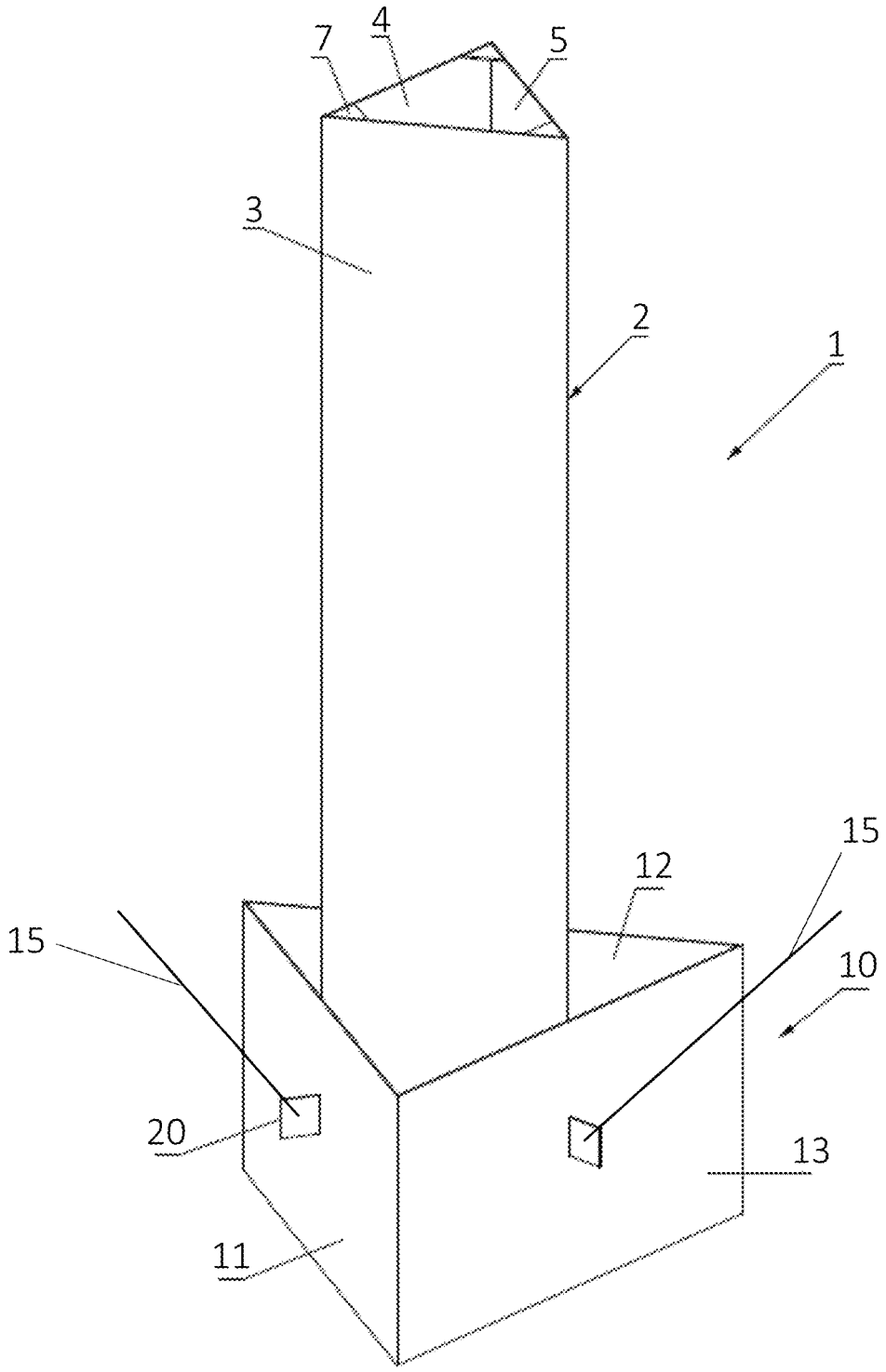
FIG. 2 shows a second embodiment of the weak soil anchor device according to FIG. 1.

Referring first to FIGS. 1 and 2, there is shown a weak soil anchor device 1 for anchoring a number of structures. The weak soil anchor device 1 is shown in a vertical operating position. The weak soil anchor device 1 consists of an elongate continuous open box construction 2 with a triangular cross-section comprising a first wall surface 3, second wall surface 4 and a third wall surface 5. An outer continuous open box structure 10 with a smaller vertical extent than the inner box structure 2 and with a triangular cross-section consisting of a first outer wall surface 11, second outer wall surface 12 and third outer wall surface 13 is connected to the inner elongate continuous open box structure 2 in a lower area of this. The vertical center area 14 of the first, second and third outer wall surfaces is connected to, respectively, an outer edge area between the first and second wall surfaces 3, 4, second and third wall surfaces 4, 5 and the third and first wall surfaces 5, 3. Referring to FIG. 1 an anchor bracket 20 is arranged respectively in each connecting area between the first and second outer wall surfaces 11, 12, second and third outer wall surfaces 12, 13 and third and first outer wall surfaces 13, 11. Further with reference to FIG. 2 the anchor bracket 20 is arranged respectively in each connecting area between the inner box structure 2 and the outer box structure 10. Anchor brackets 20 can also be arranged both in the corners of the outer box structure 10 and in the vertical center areas of the outer wall surfaces 11, 12, 13.

Figure 3:
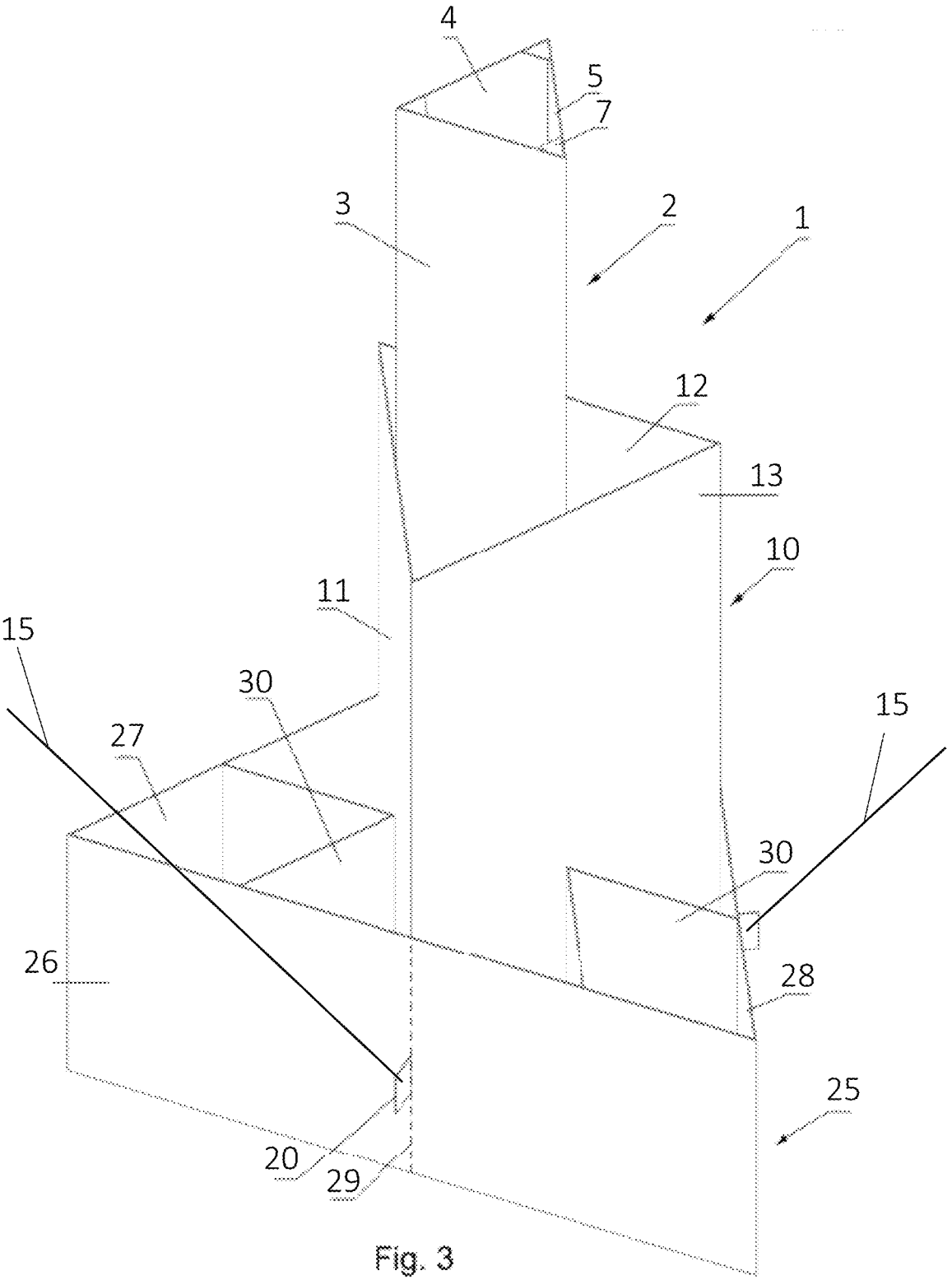
FIG. 3 shows a third embodiment of the weak soil anchor device according to the present invention.

Referring to FIG. 3 a third embodiment of the weak soil anchor device 1 is shown. The weak soil anchor device 1 here comprises a further outer continuous open box structure 25 with a triangular cross-section arranged externally of the outer continuous open box structure 10.

The further outer open box structure 25 comprises a first further wall surface 26, a second further outer wall surface 27 and a third further outer wall surface 28. A vertical center area 29 of respectively the first, second and third further outer wall surfaces 26, 27, 28 is connected to respectively a lower connecting area between the first and second outer wall surfaces 11, 12, second and third outer wall surface 12, 13, third and first outer wall surface 13, 11. An anchor bracket 20 is shown here arranged in respectively each of the vertical center areas 29 of respectively the first, second and third further outer wall surface 26, 27, 28.

The weak soil anchor device 1 according to the embodiment in FIG. 3 is further provided with bracing wall surfaces 30 extending from the vertical center area 14 of the first, second and third outer wall surfaces 11, 12, 13 to respectively the first, second and third further outer wall surfaces 26, 27, 28. The bracing wall surface 30 in this embodiment forms an angle within the range of respectively 60° and 120° with the first, second and third further outer wall surfaces 26, 27, 28. The further outer box construction 25 in this embodiment has a smaller vertical extent than the outer box construction 10. It should be mentioned in this connection that the further outer box construction 25 does not necessarily needs to extend as deep as the outer box construction 10. The elongate inner continuous open box structure 2, the outer continuous open box structure 10 and the further outer continuous open box structure 25 each have a cross section in the form of an equilateral triangle. The box constructions 2, 10, 25 can also have a triangular-shaped cross-section which is not an equilateral triangle.

The anchor brackets 20 for anchor lines are fastened in the lower part of the weak soil anchor device 1, where the total, resulting holding resistance from the adjacent ground masses acts based on the distribution of the ground resistance over the height of the anchor device. In this way, the weak soil anchor device 1 will be able to utilize the horizontal ground resistance.

Depending on the required holding force and the local ground conditions, the anchor device 1 can be formed by varying its geometry such as for example:

i) the length/height of the elongate continuous open box structure 2 and the at least one outer continuous box structure 10, 25 can be varied, ii) the cross-sectional shape of the continuous open box structures can be either an equilateral or a non-equilateral triangle, iii) the anchor brackets 20 can be selected based on the distribution of the ground resistance over the height of the anchor device, whereby the anchor brackets 20 also can be arranged in the corners of the outer box structure 10 at a level directly above the further outer box structure 25.

The weak soil anchor device 1 is as shown in FIG. 1 formed from straight plates which offer a simple and cost-effective manufacturing method. The anchor device can be manufactured and transported in a lying position.

The weak soil anchor device 1 with the triangular box structure cross-section mean that the forces from the anchor line are distributed over the total height of the anchor device 1 to the surrounding weak soils by the inherent properties of the open box structure as a continuous beam.

The anchor construction 1 is suitable for sharing of anchors, for example that a number of floats connect to the same anchor in a wind farm. In such a case the anchor device 1 must take loads from different directions. The anchor device 1 is formed to take loads in three directions and further regarding the best holding capacity being achieved deeper in the ground, whereby the majority of the structure's material (steel, concrete) is placed in this area. The principles are that there is greater holding capacity deeper in the ground and that it is therefore effective to use more material deep down, while the upper part of the anchor device 1 is more to get the anchor device 1 pressed into the ground. The triangular-shaped box constructions 2, 10, 25 facilitate large dimensions at the bottom and at the same time minimal dimensions in the upper part that contribute little to the holding force.

As previously mentioned, the weak soil anchor device 1 is formed with a view to being pressed down into the seabed by means of conventional frame equipment for piling. The frame equipment can, for example, be conventional pile hammers (drop weights or hydraulic hammers) or vibro-hammers. Reinforcement plates 7 are arranged inside in an upper area of the corners of the inner continuous box construction 2 to facilitate the use of piling equipment. The piling equipment can advantageously be mounted on the anchor device 1 on board a suitable installation vessel and lowered as a unit down to the seabed. Further driving of the anchor device 1 down into the weak soils takes place as for framing of free-standing piles.

After use, it will be possible to pull up the anchor device 1 for reuse or use of a vibrohammer combined with an upward tensile force.

The weak soil anchor device 1 is formed so that installation thereof does not have any limitations regarding soil profile. Different soil profiles will therefore not limit the use of the weak soil anchor device 1. The soil profiles often show an increasing firmness with depth. The present weak soil anchor device 1 is, as previously described, formed so that it uses as little construction material as possible in the upper soil layer, but uses more construction material in deeper and firmer soil layers. There is no need to use specially made auxiliary equipment beyond standard pile hammers for installation. The anchor device 1 can be installed in an exact, predetermined position.

Finally, it should be mentioned that the previously known anchor solutions each have one or more of the properties and advantages that the anchor device 1 according to the invention has, but the present weak soil anchor device 1 enables all these properties to be integrated in a new anchoring concept.

The invention claimed is:

1. A weak soil anchor device for anchoring one or more structures to a seabed in a vertical operating position, comprising:

an elongated inner continuous open box structure with a triangular cross-section comprising a first wall surface, a second wall surface, a third wall surface, and opposite ends, wherein the elongated inner continuous open box structure is open at both ends, and wherein the triangular cross-section of the elongated inner continuous open box structure is approximately constant along a vertical extent of the elongated inner continuous open box structure;

an outer continuous open box structure with a smaller vertical extent than the vertical extent of the inner box structure and with a larger lateral extent than a lateral extent of the inner box structure and with a triangular cross-section consisting of a first outer wall surface, second outer wall surface, third outer wall surface, and opposite ends, wherein a vertical center area of, respectively, the first outer wall surface, the second outer wall surface, and the third outer wall surface are connected to the elongated inner continuous open box structure in a lower region of an outer edge area between the first wall surface and the second wall surface, the second wall surface and the third wall surface and the third wall surface, respectively, and the first wall surface, wherein the outer continuous open box structure is open at both ends, and wherein the triangular cross-section of the outer continuous open box structure is approximately constant along a vertical extent of the outer continuous open box structure; and anchor brackets for attachment to anchor lines arranged in a lower outer area of the weak soil anchor device for utilizing a horizontal ground holding resistance of the seabed, wherein the weak soil anchor device comprising the inner box structure and the outer box structure is lowered into weak soils to a desired depth in the seabed.

2. The weak soil anchor device of claim 1, the anchor brackets being arranged respectively in each connecting area between the inner box structure and the outer box structure.

3. The weak soil anchor device of claim 1, the anchor brackets being arranged respectively in each connecting area between the first outer wall surface and the second outer wall surface, the second outer wall surface and the third outer wall surface and the third outer wall surface and the first outer wall surface.

4. The weak soil anchor device of claim 1, further comprising a further outer continuous open box structure with a triangular cross-section arranged externally of the outer continuous open box structure, the further outer open box structure comprising a first further outer wall surface, a second further outer wall surface and a third further outer wall surface, where a vertical center area of respectively the first further outer wall surface, the second further outer wall surface, and the third further outer wall surface is connected to respectively a lower connection area between the first outer wall surface and the second outer wall surface, the second outer wall surface and the third outer wall surface, the third outer wall surface and the first outer wall surface, and the anchor brackets are arranged respectively in each of the vertical center areas of respectively the first further outer wall surface, the second further outer wall surface, and the third further outer wall surface.

5. The weak soil anchor device of claim 4, bracing wall surfaces extending from the vertical center area of, respectively, the first outer wall surface, the second outer wall surface, and the third outer wall surface to respectively the first further outer wall surface, the second further outer wall surface, and the third further outer wall surface.

6. The weak soil anchor device of claim 5, the bracing wall surfaces forming an angle within a range of respectively 60 degrees and 120 degrees with the first outer wall surface, the second outer wall surface, and the third further outer wall surface.

7. The weak soil anchor device of claim 4, a further outer box structure having a smaller vertical extent than the vertical extent of the outer box structure.

8. The weak soil anchor device of claim 1, the triangular-shaped cross-section of each of the inner continuous open box structure, the outer continuous open box structure, and the further outer continuous open box structure forms an equilateral triangle.

9. The weak soil anchor device of claim 4, wherein the triangular cross-section of each of the inner continuous open box structure, the outer continuous open box structure, and the further outer continuous open box structure form a non-equilateral triangle.

10. The weak soil anchor device of claim 4, the anchor brackets being arranged in a lower area of the weak soil anchor device, wherein a total, resulting holding resistance from adjacent soil masses is selected based on a distribution of a ground resistance over a height of the anchor device.

11. The weak soil anchor device of claim 4, the weak soil anchor device wherein a holding force and ground conditions in that a geometry of the anchor device is varied with respect to: a vertical extent of the inner continuous open box structure, the outer continuous open box structure, the triangular cross-section of the inner continuous open box structure and the outer continuous open box structure; and a placement of the anchor brackets is selected on the basis of a distribution of a ground resistance over a length of the anchor device.

12. The weak soil anchor device of claim 1, the weak soil anchor device being made of steel.

13. A method of arranging a weak soil anchor in weak soils to anchor one or more structures to a seabed, comprising:

fitting the weak soil anchor device with anchor lines attached to anchor brackets, the weak soil anchor device comprising an elongated inner continuous open box structure with a triangular cross-section comprising a first wall surface, a second wall surface, a third wall surface, and opposite ends, wherein the elongated inner continuous open box structure is open at both ends, and wherein the triangular cross-section of the elongated inner continuous open box structure is approximately constant along a vertical extent of the elongated inner continuous open box structure, an outer continuous open box structure with a smaller vertical extent than a vertical extent of the inner box structure and with a larger lateral extent than a lateral extent of the inner box structure and with a triangular cross-section consisting of a first outer wall surface, second outer wall surface, third outer wall surface, and with opposite ends, wherein a vertical center area, respectively, of the first outer wall surface, the second outer wall surface, and the third outer wall surface are connected to the elongated inner continuous open box structure in a lower region of an outer edge area between the first wall surface and the second wall surface, the second wall surface and the third wall surface and the third wall surface and the first wall surface, respectively, wherein the outer continuous open box structure is open at both ends, and wherein the triangular cross-section of the outer continuous open box structure is approximately constant along a vertical extent of the outer continuous open box structure; and wherein the anchor brackets are arranged in a lower outer area of the weak soil anchor device for utilizing a horizontal ground holding resistance of the seabed;

lowering the weak soil anchor device with a lower end area of the weak soil anchor device towards the weak soils; and pressing the weak soil anchor device into the weak soil seabed with conventional piling frame equipment or by using a vibrohammer.

14. The method of claim 13, further comprising:

retrieving the weak soil anchor device from the weak soil seabed by using the vibrohammer combined with an upward pulling force.

* * * * *